United States Patent [19]

Berger et al.

[11] Patent Number: 4,487,559

[45] Date of Patent: Dec. 11, 1984

[54] HYDRAULIC MACHINE WITH RETRACTABLE PARTITIONS AND VARIABLE CUBIC CAPACITY

[75] Inventors: Antoine Berger; Francois Gibert, both of Loire, France

[73] Assignee: Centre Stephanois De Recherches Mecaniques Hydromecanique et Frottement, Loire, France

[21] Appl. No.: 528,994

[22] Filed: Sep. 2, 1983

Related U.S. Application Data

[63] Continuation of Ser. No. 293.558, Aug. 17, 1981, abandoned, which is a continuation of Ser. No. 969,229, Dec. 13, 1978, abandoned.

[30] Foreign Application Priority Data

Dec. 13, 1977 [FR] France ..... 77 38914

[51] Int. Cl.[3] ..... F03C 2/00

[52] U.S. Cl. ..... 418/25; 418/27; 418/28

[58] Field of Search ..... 418/24–28

[56] References Cited

U.S. PATENT DOCUMENTS

| | | | |
|---|---|---|---|
| 1,276,372 | 8/1918 | Johnson | 418/28 |
| 1,527,685 | 2/1925 | Huwiler | 418/28 |
| 1,532,735 | 4/1925 | Dickerson | 418/28 |
| 2,398,313 | 4/1946 | Jensen | 418/28 |

FOREIGN PATENT DOCUMENTS

| | | | |
|---|---|---|---|
| 102700 | 12/1937 | Australia | 418/28 |
| 8675 | 4/1912 | United Kingdom | 418/28 |

*Primary Examiner*—John J. Vrablik

*Attorney, Agent, or Firm*—Remy J. VanOphem

[57] ABSTRACT

A hydraulic motor of variable cubic capacity with retractable partitions housed in radial grooves in a rotor. The partitions are each integral with a guide pin trapped in an endless cam groove of approximately ovoid shape in a surface stator. The partitions also pass through radial grooves in a sleeve housed in a circular groove in the rotor in order to slide therein parallel to the axis of the motor. A reaction member passes through an aperture in the stator in order to remain in frictional contact with an end surface of the sleeve. The driving force comes from oil pressure in a circular groove defined between the end surface of the sleeve and the surface of the stator. The sleeve and reaction member slide jointly.

5 Claims, 29 Drawing Figures

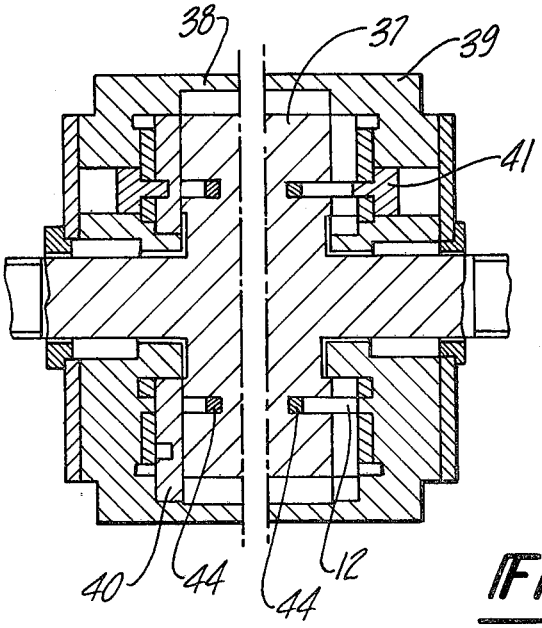
Fig-20
Fig-21
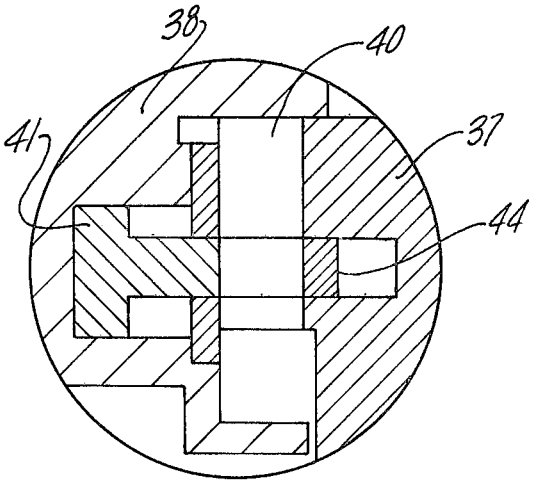
Fig-22

HYDRAULIC MACHINE WITH RETRACTABLE PARTITIONS AND VARIABLE CUBIC CAPACITY

This is a continuation of application Ser. No. 293,558 filed Aug. 17, 1981 which was a continuation of Ser. No. 969,229 filed Dec. 13, 1978 both abandoned.

BACKGROUND OF THE INVENTION

1. Field of the Invention

The present invention makes it possible to introduce a variation in the cubic capacity of hydraulic machines, pumps, or motors, of the type "having retractable partitions".

2. Description of the Prior Art

Hydraulic machines of the type "having retractable partitions" are known. They include a channel blocked by members, some of which are integral with a rotor and others with a stator. Certain of these members, constituting retractable partitions, draw back on reaching the level of the others, which constitute reaction members. A fluid under pressure penetrates the channel downstream of the reaction members and orifices connected to the fluid reservoir are provided upstream of the reaction members.

SUMMARY OF THE INVENTION

The invention provides a variable cubic capacity for these machines.

A hydraulic machine according to the invention includes at least one channel and, in each channel, on the one hand, at least one reaction member integral with the stator of the machine and, on the other hand, retractable partitions integral with the rotor of the machine. Means are provided for drawing the retractable partitions back as they arrive in front of a reaction member, in order to introduce a fluid under pressure into the channel downstream of these reaction members and to allow the fluid to leave the channel upstream of these same members. The machine is characterized in that it includes adjustment means making it possible to vary the width of the channel measured parallel to the axis of the machine.

According to an additional feature of the invention, the channel is defined in the direction of its width, on the one hand between the surface of a stationary side plate integral with the stator and, on the other hand, the surface of an axially movable sleeve. This sleeve rotates with the rotor and includes recesses inside which the retractable partitions are able to move. The reaction members move longitudinally parallel to the axis in openings in the stationary side plate, thus completely occupying the section of these apertures and remaining constantly in contact by their front face abutting against the surface of the movable sleeve.

According to an additional feature of the invention, the movable surface of the channel, supported by the movable sleeve housed in a circular groove in the rotor, the movable sleeve rotating with the rotor and being able to slide axially in the rotor, is kept permanently in abutment against the reaction members by means of a return system acting either on the movable sleeve or on the reaction members.

According to an alternate embodiment of the invention, the channel is defined by the base of a circular groove provided in an axial face of the rotor and by the edge of a lip of a second part of the stator. This stator includes first part supporting reaction members which pass through the first part by way of notches provided for this purpose. The front end of the reaction members always remains in frictional contact with the base of the groove, whereas the second part of the aforementioned stator is able to slide axially with respect to the first part and with respect to the rotor.

BRIEF DESCRIPTION OF THE DRAWINGS

The accompanying drawings, given as a nonlimiting example, will make it easier to understand the features of the invention.

FIG. 20 is a sectional view on line XX—XX of FIG. 19;

FIG. 21 is a sectional view on line XXI—XXI of FIG. 19;

FIG. 22 is a partial view of FIG. 20, at another stage of the operation.

DESCRIPTION OF THE PREFERRED EMBODIMENT

Figure 2:
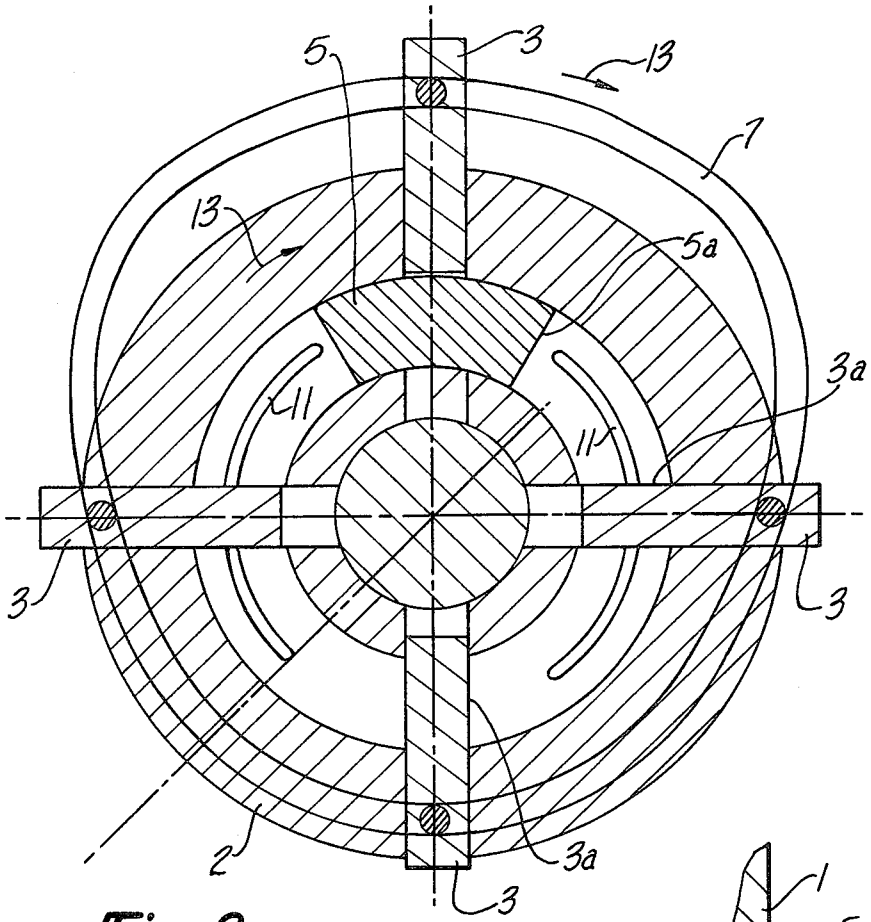
FIG. 2 is a sectional view on line II—II of FIG. 1.
Figure 1A:
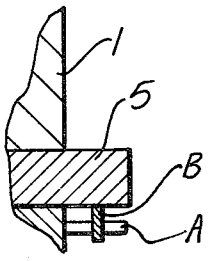
FIG. 1*a* is a sectional view similar to a portion of FIG. 1 but illustrating a modification therefrom.
Figure 1:
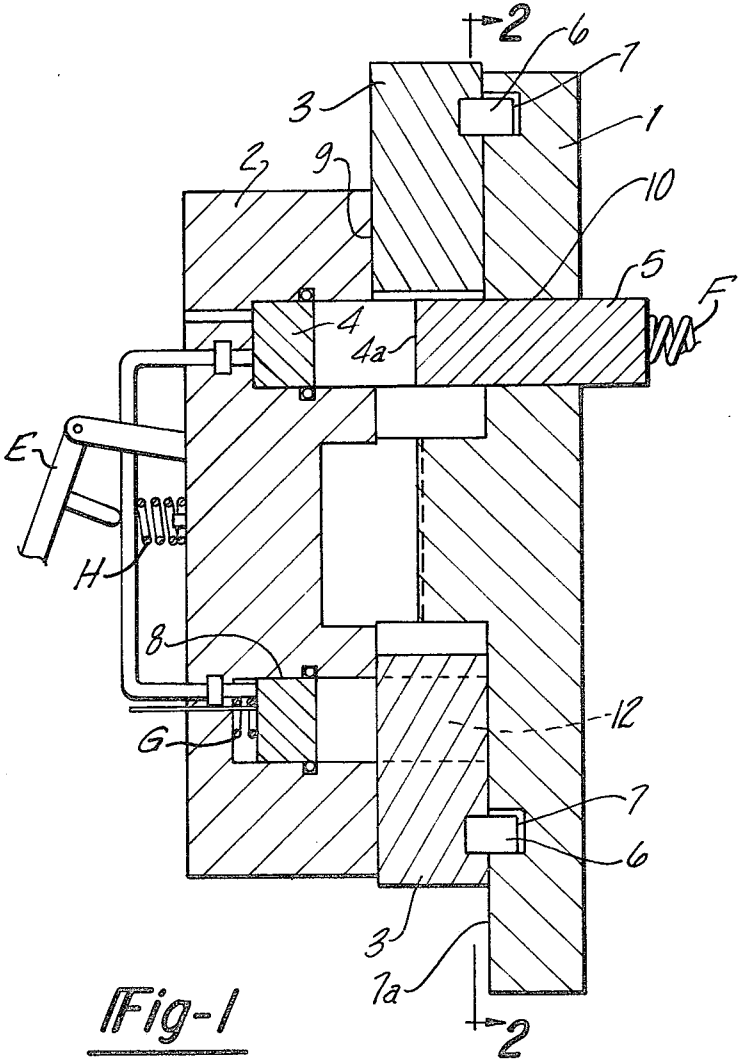
FIG. 1 is an axial sectional view of a hydraulic machine according to the invention.
Figure 3:
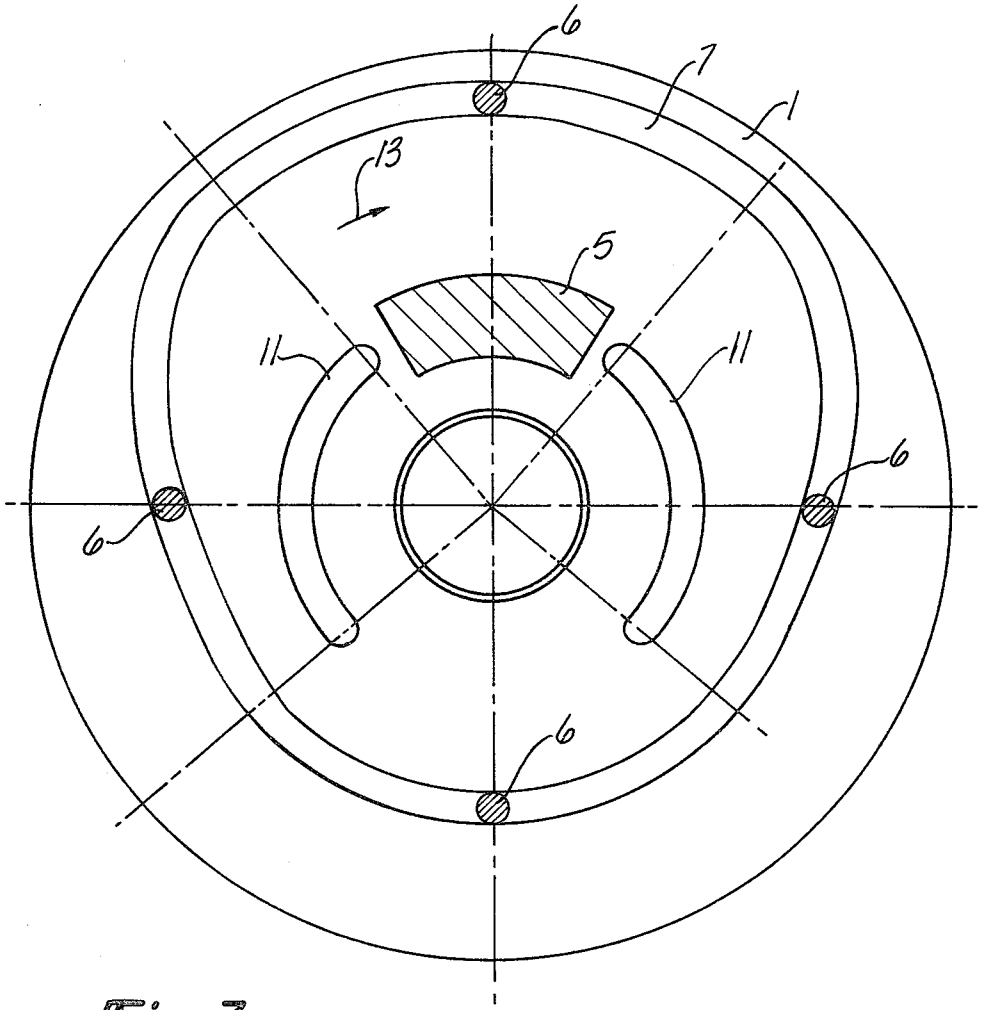
FIG. 3 is a sectional view on line II—II of FIG. 1, without the rotor or partitions.

FIGS. 1 to 3 show a motor according to the invention, including a stator 1, a rotor 2, four retractable partitions 3, a movable sleeve 4 and a reaction member 5.

Figure 6:
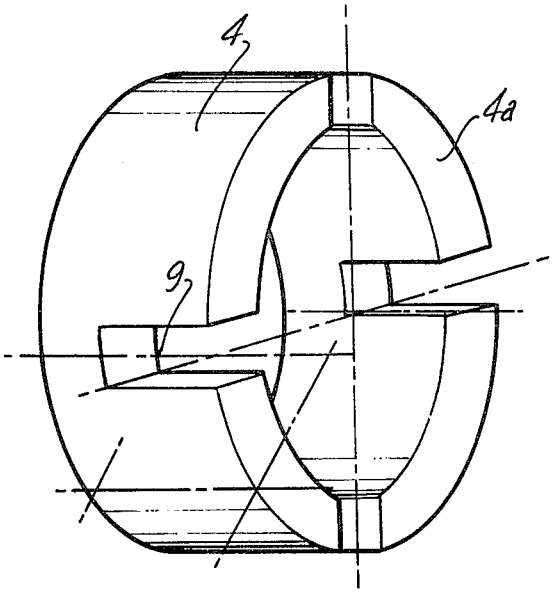
FIGS. 6 and 7 are perspective views of two members of the hydraulic machine.
Figure 7:
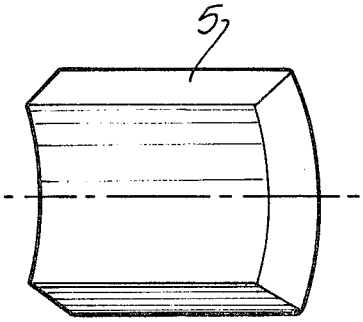

The partitions 3 are able to slide in radial grooves in the rotor 2 and each of the former is integral with a plurality of guide pins 6 forming a follower roller, the guide pins 6 being trapped in a groove 7 forming a cam, provided in one face of the stator 1. The movable sleeve 4, which is visible in FIG. 6, is housed inside a circular groove 8 in the rotor 2. The movable sleeve also includes radial grooves 9 which are necessary for the sliding of the partitions 3. Control means (not shown) make it possible to slide the sleeve 4 parallel to the axis inside the rotor 2. The reaction member 5, visible in FIG. 7, passes through an aperture 10 in the stator 1. It fills the section of this aperture in a sealed manner, while being able to slide therein parallel to the axis. The portion of the reaction member 5 which projects from the stator 1 adjacent the rotor 2 is engaged in the circular groove 8 in the latter. The stator 1 further includes arcuate slots 11 for the intake and discharge of supply fluid.

The operation is as follows:

The oil which has passed through the stator flows through one of the arcuate slots 11 into a portion X of a channel 12. This channel 12 is limited, in the circular groove 8, between a stationary surface 1*a* of the stator and a moving surface 4*a* of the movable sleeve 4 (c.f. FIGS. 1 and 6). The portion X of the channel 12 is the sector between the reaction member 5 and the closest partition 3 which blocks the channel 12. Assuming that in FIG. 3, the oil intake orifice is that on the right-hand side, the direction of rotation of the rotor is indicated by the arrow 13 and the fluid leaves through the other slot 11 located on the left-hand side.

Figure 4:
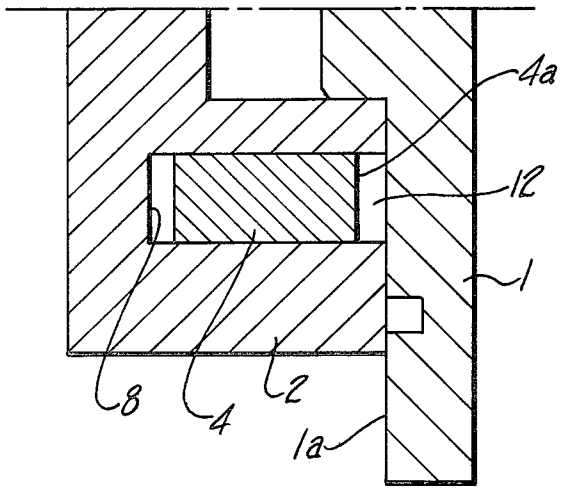
FIGS. 4 and 5 show portions of FIG. 1, illustrating the various operating positions.
Figure 5:
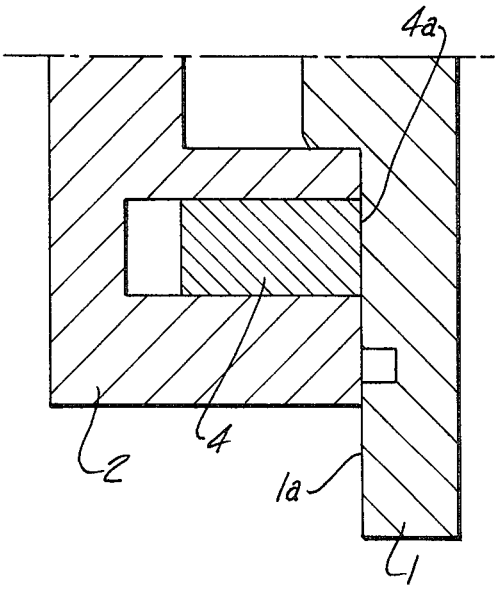

The outline of the groove 7 is such that during the rotation of the rotor 2, each partition 3 is withdrawn from the channel 12 at the level of the reaction member 5, for this, thus sliding outwardly in the corresponding radial groove of the rotor. As in all hydraulic machines including retractable partitions, the rotor is set in rotation under the effect of pressure forces which are exerted in the channel 12 between the downstream face 5*a* of the reaction member 5 and an upstream face 3*a* of the partitions 3 (FIG. 2). The novelty of the machine according to the invention resides in that it is possible to vary the cubic capacity and therefore the power, by jointly moving the reaction member 5 and the sleeve 4 parallel to the axis. FIG. 1 shows the machine in the position in which the cubic capacity is maximum, the sleeve 4 abutting against the base of the circular groove 8 in the rotor 2. By way of non-limiting example, the adjusting means may be a lever E and springs F and G or in the alternative, the adjusting means may be hydraulic (not shown). FIG. 1*a* shows the use of a screw member A to an appending member B connected to reaction member 5 to control the capacity of the chamber. In the alternative, the spring member F acting on reaction member 5 is shown in FIG. 1. FIG. 4 illustrates an intermediate position and FIG. 5 illustrates a position of zero cubic capacity where the surfaces 1*a* and 4*a* are adjacent each other. It will be understood that the longitudinal movement of the reaction member 5 and of the sleeve 4 in no way impairs the cyclic movement of the partitions 3 which are defined by the shape of the groove 7.

Figure 8:
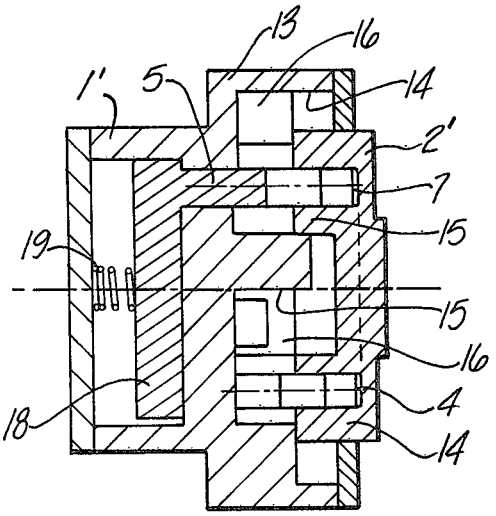
FIG. 8 is an axial sectional view of a hydraulic machine according to a variation of the invention.
Figure 9:
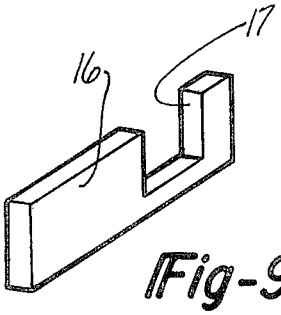
FIGS. 9 and 10 are perspective views of two members of the machine of FIG. 8.
Figure 10:
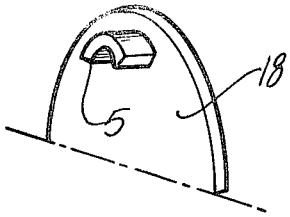

As a variation, FIGS. 8 and 10 illustrate a machine in which the stator 1' includes two concentric cams 14 and 15 against which the two ends of each retractable partition respectively bear, the partitions 16 sliding as previously in radial grooves provided in the rotor 2' and in the sleeve 4 housed in the groove 7 in the rotor 2'. As can be seen from FIG. 9, each partition 16 is different from the partitions 3 in that it includes a notch 17. Thus, contrary to what was provided in the preceding case, the alternating radial movement of the retractable partitions does not lead the latter to slide completely out of the channel 12 at the level of the reaction member 5. The cams 14 and 15 are arranged such that the reaction member 5 passes in succession through all the notches 17 of the partitions 16.

The drawings show a plate 18, to which the rear end of the reaction member 5 is connected (FIGS. 8 and 10). This plate is permanently subjected to the action of a return spring 19 which returns the reaction member 5 into abutment with the sleeve 4. In order to vary the cubic capacity, the sleeve 4 is moved parallel to the axis by an adjusting means, for example hydraulic or mechanical means.

Figure 11:
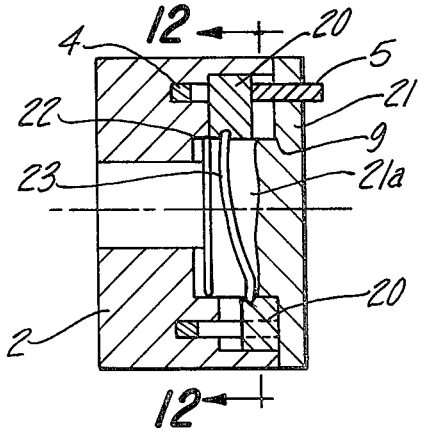
FIG. 11 is an axial sectional view of a hydraulic machine according to another variation of the invention.
Figure 12:
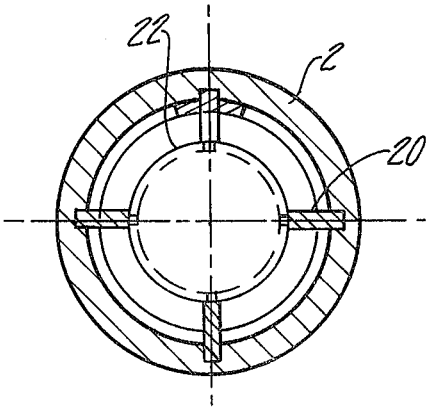
FIG. 12 is a sectional view on line XII—XII of FIG. 11.
Figure 13:
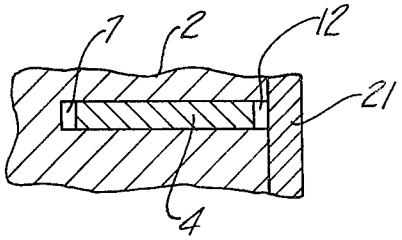
FIG. 13 is a partial view of FIG. 12, at another stage of the operation.
Figure 14:
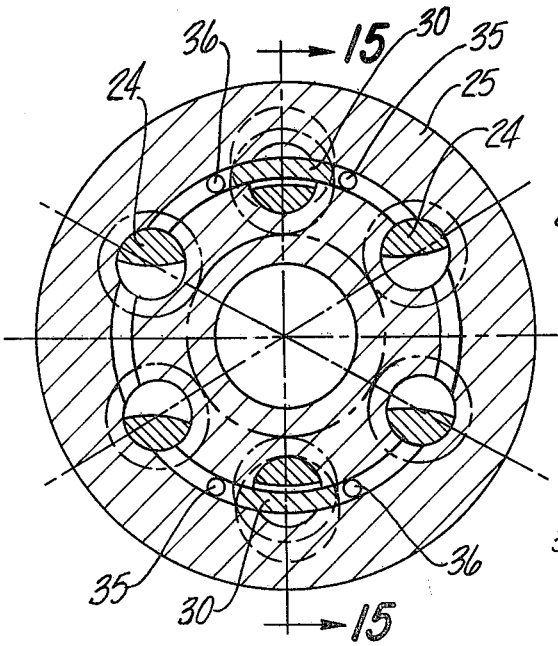
FIG. 14 is a cross-sectional view of a machine according to another variation of the invention.

According to another variation, FIGS. 11 and 12 show a machine in which retractable partitions 20 withdraw by sliding parallel to the axis of the machine, in order to pass beyond the front edge of the reaction member 5. The inner edge of the partitions 20 slides about a cylindrical core 21*a* of a stator 21. Each partition includes a pin 22 engaged in a cam-groove 23 of the core 21*a* and it is this cam-groove 23 which controls the axial sliding movement of the partitions 20. Overall, the operation remains the same as previously, due to the simultaneous axial movement of the reaction member 5 and of the sleeve 4 housed in the groove 7 in the rotor 2'. The radial grooves 9 in the sleeve 4 must simply be deeper, in view of the axial movement of the partitions. FIG. 11 shows the machine in the position of maximum cubic capacity, with the sleeve 4 abutting against the base of the groove 7. FIG. 13 shows the machine in the position of intermediate cubic capacity, the cross-section of the channel 12 being reduced by half relative to the position of FIG. 12.

Figure 15:
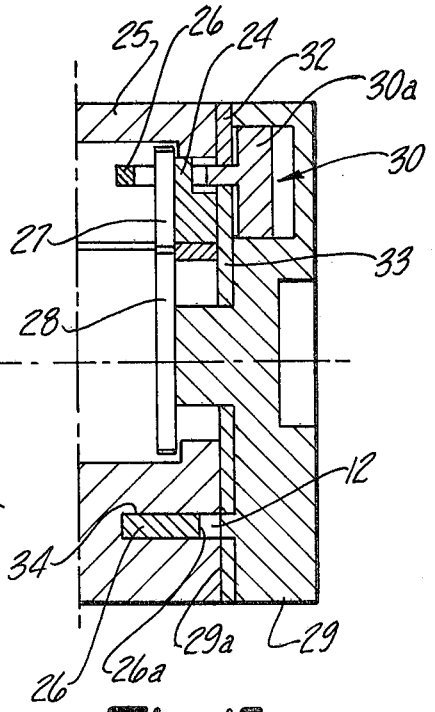
FIG. 15 is a sectional view on line XV—XV of FIG. 14.
Figure 16:
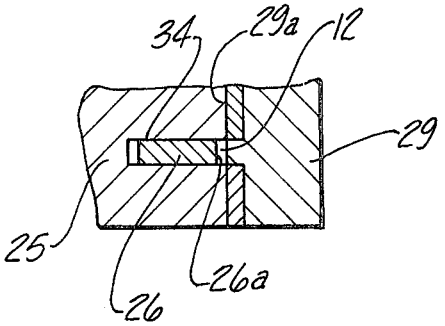
FIG. 16 is a partial view of FIG. 15, at another stage of the operation.
Figure 17:
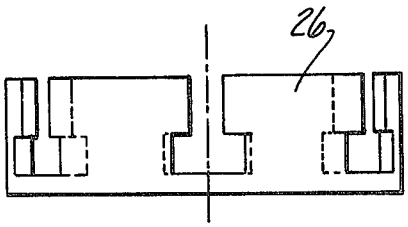
FIG. 17 is a side view of part of the machine.
Figure 18:
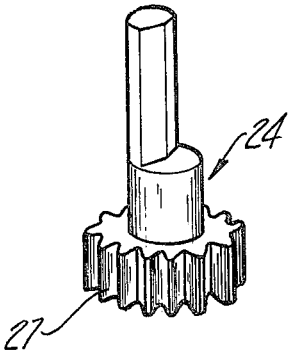
FIG. 18 is a perspective view of part of the same machine.
Figure 19:
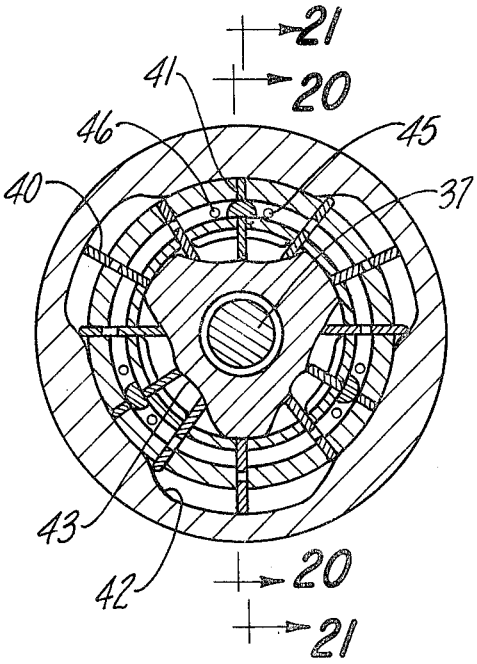
FIG. 19 is a cross-sectional view of a machine according to another variation of the invention.
Figure 23:
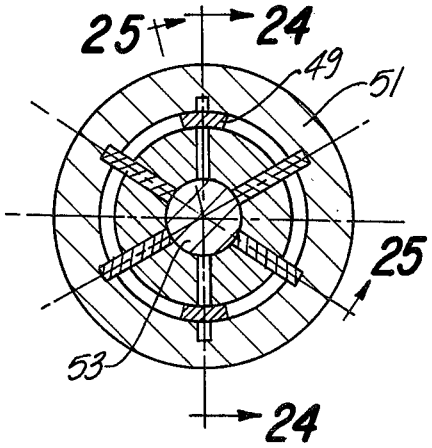
FIG. 23 is a sectional view on line XXIII—XXIII of FIG. 24 of a machine according to another variation of the invention.
Figure 24:
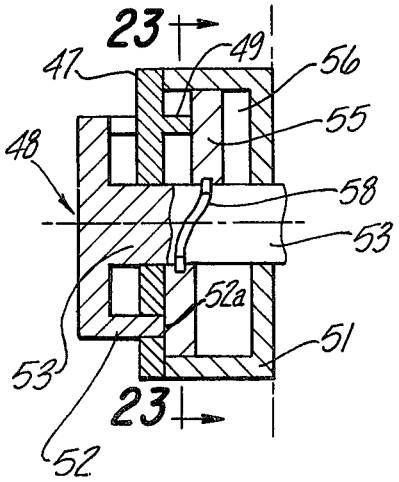
FIG. 24 is a sectional view on line XXIV—XXIV of FIG. 23.
Figure 25:
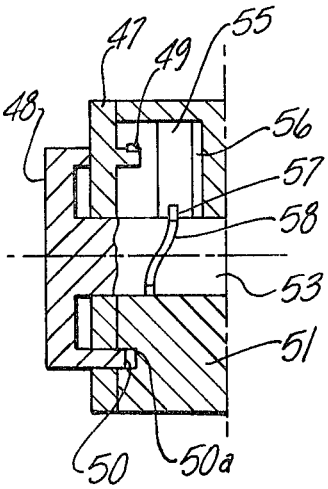
FIG. 25 is a sectional view on line XXV—XXV of FIG. 23.
Figure 26:
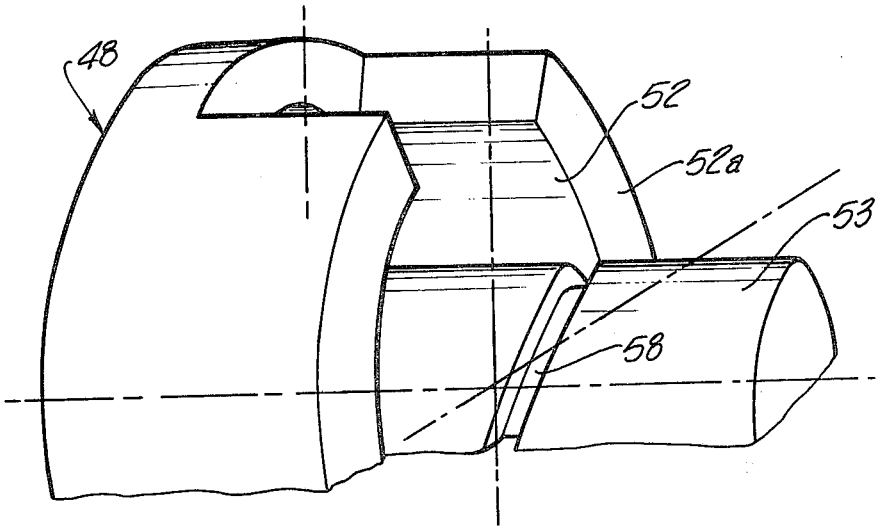
FIGS. 26 and 27 are perspective views of two members of the machine.
Figure 27:
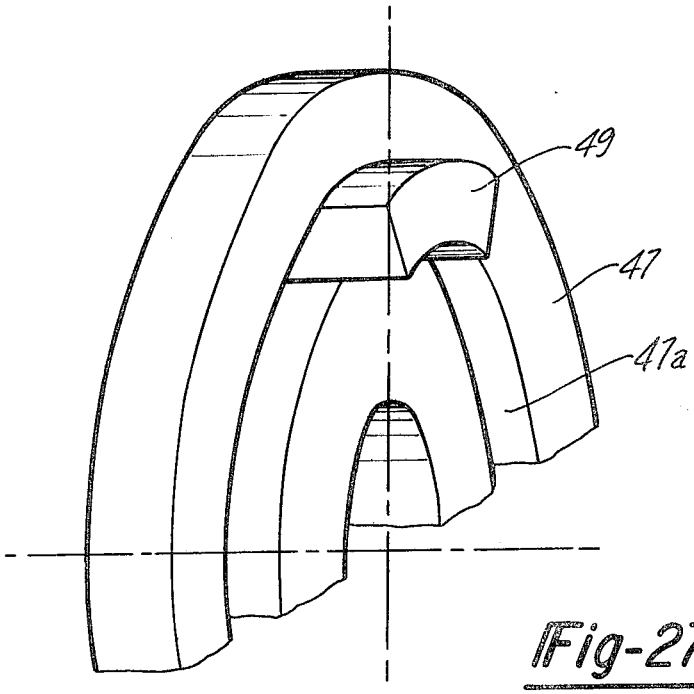

According to another variation illustrated in FIGS. 14 to 18, the retractable partitions are constituted by notched spindles 24 mounted to rotate about their axis, parallel to that of the machine. Each spindle 24 is housed in a rotor 25 in a bore located at the level of a sleeve 26, fulfilling the same function as the sleeve 4, but slightly different since it includes axial grooves with surfaces in the form of a portion of a cylinder in order to receive the spindles 24. It will be noted that the notched part of each spindle 24 remains defined between two meridian planes forming an angle therebetween which will be determined in order to allow the passage of the reaction member despite the simultaneous rotation of the spindles 24. At the rear, each spindle is connected to a pinion 27 meshing with a gear wheel 28 integral with a stator 29. Without changing the principle of the machine, the gear wheel 28 may have internal or external toothing. This machine includes two reaction members 30 placed at diametrically opposed locations and each constituted by a notched spindle, for the sake of ease of construction. Each reaction member 30 is integral with a cylindrical heel member 30*a* housed in a bore 31 in the stator, whereas its active part passes between two concentric rings 32 and 33 which are in one piece with the stator. The sleeve 26 and the reaction members 30 slide jointly parallel to the axis of the machine, while remaining constantly in sliding contact by their opposed surfaces. The channel 12 is still defined between a stationary surface 29*a* of the stator 29 and a movable surface 26*a* of the sleeve 26 in a circular groove 34 of the rotor 25 (FIGS. 15 and 16).

The operation remains the same in principle. The retraction of the partitions is brought about by the fact that upon the occasion of each passage of a spindle 24 in the region of one of the two reaction members 30, it is the notch in the spindle which is located in the region of the circular groove 34. This follows from the ratio of the gearing formed by each pinion 27 meshing with the gear wheel 28. The oil penetrates the channel 12 through two orifices 35 located downstream of the reaction members 30 and escapes through two orifices 36 located upstream of the reaction members members.

According to another variation illustrated in FIGS. 19 to 22, the machine includes a central rotor 37 associated with two half stators 38 and 39. Each half stator is associated with twelve retractable partitions 40 and with three reaction members 41. The retractable partitions 40 each include a notch which is identical to the notch 17 in the partition 16 illustrated in FIG. 9 and slides radially in a cyclic manner depending on the shape of two concentric cams 42 and 43 provided in each half stator, according to an operation which remains the same in principle, as for the machine of FIGS. 8 and 9. Each reaction member 41 is substantially identical to the reaction members 30 described above, being constantly in sliding contact with a sleeve 44, each sleeve 44 and the three corresponding reaction members 41 sliding jointly. Located on either side of each reaction member 41 is a downstream oil intake orifice 45 and an upstream oil discharge orifice 46.

The operation remains the same as previously described. The cubic capacity of the motor is variable as described above. FIGS. 20 and 21 show the position of maximum cubic capacity. FIG. 22 shows the position of zero cubic capacity.

According to another variation illustrated in FIGS. 23 to 27, the machine includes a stator including two parts 47 and 48. The first part 47 includes diametrically opposed reaction members 49, which are fully engaged in a circular groove 50 in the rotor 51. This first part 47 of the stator and the rotor 51 never move parallel to the axis of the machine. The second part 48 of the stator includes an annular lip 52 and a central core 53 which is coaxial with the annular lip 52. The annular lip 52 extends across a partial circular groove **47*a* in the first part 47 of the stator. This lip itself includes two diametrically opposed notches which receive the opposed reaction members 49. The channel 12 of the machine is in this case defined between a free edge 52*a* of the annular lip 52 and a base 50*a* of the circular groove 50 provided in the rotor 51, the annular lip 52 being engageable with the circular groove 50. The machine also includes six retractable partitions 55 which slide parallel to the axis in radial grooves 56 in the rotor 51 and which each include a guide pin 57 engaged in a cam-groove 58 of the central core 53. In this case, in order to change the width of the channel 12, reference should be made to the description of the operation given above with respect to the machine of FIGS. 11 and 12**.

The specific examples described above are given as nonlimiting examples. It will be apparent to those skilled in the art that other arrangements could be envisaged within the framework of the present invention such modifications will be within scope of the present invention provided that they include a channel of variable depth, defined in sectors by a succession of reaction members and retractable partitions.

Two examples of other types of machine according to the present invention and included within the scope of the claims appended hereto are described briefly below.

In one alternate example, the reaction member 67, in abutment with a sleeve 63, may belong to the arrangement of rotor members and the retractable partitions to the arrangement of stator members, contrary to what was described in the nonlimiting examples given above.

Figure 8A:
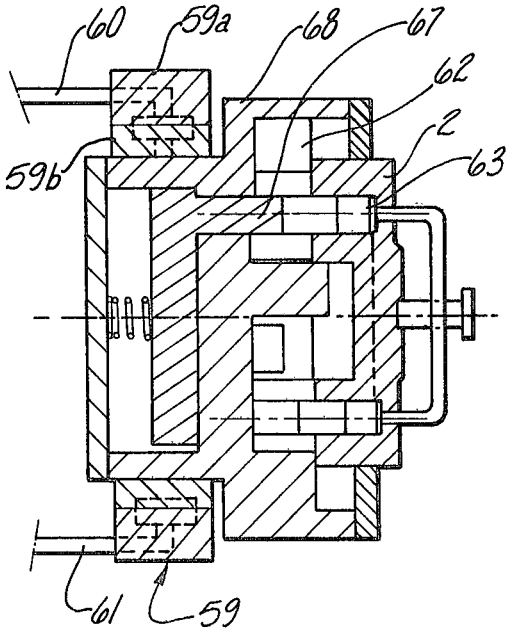
FIG. 8A is an identical view to that of FIG. 8, according to another variation of the invention.

In another alternate example, it is also possible to reverse the rotor part and the stator part, as illustrated in FIG. 8A, where the part 2 becomes stationary whereas part 68 rotates. The connection to the hydraulic circuit is made by means of a rotary joint 59 of conventional type. The oil supply pipe 60 and oil return pipe 61 are connected to the stationary part **59*a* of the rotary joint, whereas the movable part 59*b* of the joint is connected to the part 68**.

Furthermore, in all the cases described, the axial movement of the parts defining the channel 12 may be obtained by any known mechanical system such as a cam, screw/nut, lever or the like, by any known hydraulic system such as a jack actuated by a pressurized circuit or governed by the pressure of the fluid entering the motor, or by a combination of these known means, for example by a mechanical system assisted by a jack with a control valve.

Nevertheless, the axial movement may be carried out according to any chosen or predetermined law of movement.

The main advantage of the hydraulic machines described resides in the fact that it is possible to vary their cubic capacity and therefore their power, torque, or speed at will, as they operate, the cubic capacity being able to vary between a maximum value and zero value.

It is understood that in the description and claims of the present invention, the term "hydraulic" is to be understood in its widest sense, such as that of a pressurized fluid machine. Consequently, the present invention covers not only incompressible liquid machines, but compressible fluid machines, in particular pneumatic machines, compressors or compressed air engines.

What is claimed is:

1. A hydraulic machine having a source of fluid for driving said hydraulic machine, said hydraulic machine comprising:

a stator having a longitudinal axis and a first face disposed transversely across said longitudinal axis;

a rotor mounted adjacent said stator, said rotor being rotatably movable relative thereto about said longitudinal axis, said rotor further having a second face contiguous with said first face of said stator for communication therewith;

a circumferentially sealed circular groove formed in said second face of said rotor, said circumferentially sealed circular groove having an annular base disposed a first predetermined depth into said rotor from said first face of said stator;

inlet fluid aperture means formed in said first face of said stator and opening into a first portion of said circumferentially sealed circular groove, said inlet fluid aperture means being interconnected with said source of fluid such as to supply said first portion of said circumferentially sealed circular groove with fluid;

outlet fluid aperture means formed in said first face of said stator and opening into a second portion of said circumferentially sealed circular groove, said outlet fluid aperture means being interconnected with said source of fluid such as to permit discharge of fluid from said second portion of said circumferentially sealed circular groove;

an axially movable sleeve member slidably and sealingly mounted in said circumferentially sealed circular groove such as to be selectively movable towards and away from said first face of said stator, said axially movable sleeve member having a first annular face disposed adjacent said annular base of said circumferentially sealed groove and a second annular face disposed adjacent said first face of said stator, said first annular face being spaced a second predetermined distance from said second annular face, said second predetermined distance being less than said first predetermined distance, said axially movable sleeve member defining a first predetermined volume of fluid between said first face of said stator and said second annular face of said axially movable sleeve member, said first predetermined volume varying with the axial position of said axially movable sleeve member in said circumferentially sealed circular groove relative to said annular base;

an aperture through said first face of said stator at a location between said inlet fluid aperture means and said outlet fluid aperture means, said aperture being aligned with a portion of said circumferentially sealed circular groove;

a slidably movable reaction member slidably and sealingly mounted in said aperture through said first face of said stator and extending therefrom into said circumferentially sealed circular groove, said slidably movable rection member sealingly engaging an intermediate portion of said circumferentially sealed circular groove between said first and second portions thereof and being selectively sealingly engageable with a portion of said axially movable sleeve member, said slidably movable reaction member further being axially movable within said aperture towards and away from said annular base of said circumferentially sealed circular groove;

biasing means, biasing said axially movable sleeve member against said slidably movable reaction member such that said slidably movable reaction member sealingly engages said axially movable sleeve member, said slidably movable reaction member thereby being selectively movable to vary said first predetermined volume between predetermined minimum and maximum values to vary the power of said hydraulic machine;

a first plurality of radial slots formed in said second face of said rotor and extending across said circumferentially sealed circular groove a third predetermined depth into said second face of said rotor, said third predetermined depth being less than said first predetermined depth;

a second plurality of radial slots formed in said axially movable sleeve member and aligned with said first plurality of radial slots;

a plurality of radially movable partition members each reciprocably disposed in one of said first plurality of radial slots, each of said plurality of radially movable partition members being selectively movable radially inwardly into one of said second plurality of radial slots such as to extend across said circumferentially sealed circular groove and further such as to cooperate with said slidably movable reaction member to sealingly divide said first predetermined volume of said circumferentially sealed circular groove into at least one input chamber having a second volume and at least one discharge chamber having a third volume, said at least one input chamber opening into said inlet fluid aperture means, said at least one discharge chamber opening into said outlet fluid aperture means, each of said plurality of radially movable partition members selectively cooperating with said slidably movable reaction member to vary said second and third volumes as said rotor rotates relative to said stator; and guide means guiding said plurality of radially movable partition members in said plurality of first and second radial slots such as to avoid interference with said slidably movable reaction member as said rotor rotates relative to said stator, said guide means moving each of said plurality of radially movable partition members radially outwardly away from said second plurality of radial slots such as to avoid said interference.

2. The hydraulic machine of claim 1 wherein said inlet fluid aperture means further comprises said stator having a portion defining a first arcuate slot.

3. The hydraulic machine of claim 2 wherein said outlet fluid aperture means further comprises said stator having a portion defining a second arcuate slot adjacent but spaced away from said first arcuate slot.

4. The hydraulic machine of claim 1 wherein said guide means further comprises:

a cam means formed in said first face of said stator; and a plurality of follower means each interconnected with one of said plurality of radially movable partition members.

5. The hydraulic machine of claim 4 wherein said cam means comprises a cam-groove and each of said follower means comprises a pin.

* * * * *

UNITED STATES PATENT AND TRADEMARK OFFICE

CERTIFICATE OF CORRECTION

PATENT NO. : 4,437,559

DATED : December 11, 1984

INVENTOR(S) : Berger, et al.

It is certified that error appears in the above-identified patent and that said Letters Patent is hereby corrected as shown below:

Column 4, line 15, delete "an adjusting" and insert ---- any adjusting ----.

Column 5, line 11, delete "members", second occurrence.

Column 6, line 5, after "retractable partitions" insert ---- 62 ----.

Column 6, line 10, delete "part 2" and insert ---- rotor 2 ----.

Signed and Sealed this

*Seventh* Day of *May 1985*

[SEAL]

*Attest:*

DONALD J. QUIGG

*Attesting Officer* *Acting Commissioner of Patents and Trademarks*